US010028624B1

(12) United States Patent
Robinson

(10) Patent No.: US 10,028,624 B1
(45) Date of Patent: Jul. 24, 2018

(54) WEARABLE TREATMENT SUBSTANCE DISPENSER

(71) Applicant: Ernest Radford Robinson, Lithonia, GA (US)

(72) Inventor: Ernest Radford Robinson, Lithonia, GA (US)

( * ) Notice: Subject to any disclaimer, the term of this patent is extended or adjusted under 35 U.S.C. 154(b) by 0 days.

(21) Appl. No.: 15/416,821

(22) Filed: Jan. 26, 2017

(51) Int. Cl.
*A47K 5/12* (2006.01)
*H04L 29/08* (2006.01)
*H04B 1/3827* (2015.01)

(52) U.S. Cl.
CPC ..... *A47K 5/1217* (2013.01); *A47K 5/1201* (2013.01); *A47K 5/1202* (2013.01); *H04B 1/385* (2013.01); *H04L 67/10* (2013.01)

(58) Field of Classification Search
CPC ... B05B 7/1413; B05B 7/1427; B05B 7/2402; B05B 7/2475; A47K 5/1217; A47K 5/1201; A47K 5/1202; A47K 5/1208; A47K 5/1211; A47K 5/122; A47K 5/1215; H04B 1/385; H04L 67/10
USPC ..... 222/175, 206–215, 92–107, 182, 183, 222/630–633
See application file for complete search history.

(56) References Cited

U.S. PATENT DOCUMENTS 5,217,143 A * 6/1993 Aitken ..... A44C 15/002 206/823
5,316,182 A * 5/1994 Lee ..... A63H 33/00 222/175
5,358,144 A * 10/1994 Mock ..... F41H 9/10 222/175
5,927,548 A * 7/1999 Villaveces ..... A45F 5/02 222/175
6,506,183 B2 * 1/2003 Cogger ..... A61F 9/0008 604/218
6,814,265 B2 * 11/2004 Clifford ..... A61F 9/0008 222/182
7,316,332 B2 1/2008 Powers et al.
8,286,834 B2 * 10/2012 Powers ..... A45D 34/00 222/175
8,844,766 B2 * 9/2014 Zaima ..... A61L 2/26 222/162
8,902,713 B2 * 12/2014 Alameh ..... G04G 21/08 341/22
2011/0155765 A1 6/2011 Properzi
2012/0282011 A1 11/2012 Francois
2013/0334248 A1 * 12/2013 Iseri ..... A47K 5/1211 222/82
2015/0216367 A1 * 8/2015 Barbier ..... A47K 5/1201 222/1
2017/0156454 A1 * 6/2017 Abadi ..... A44C 5/0023

* cited by examiner

*Primary Examiner* — Charles P Cheyney
(74) *Attorney, Agent, or Firm* — Alston & Bird LLP

(57) ABSTRACT

A wearable sanitizing system comprising a treatment substance dispenser typically affixed to a strap and securing a cartridge capable of containing a treatment substance. The treatment substance dispenser comprises an actuating portion that may dispense the contents of said cartridge. Buttons on the strap may facilitate actuation of a portion of the treatment substance dispenser. A computing device affixed to the strap comprises one or more wireless communications modules and one or more sensors. At least one of said sensors determines whether an actuation of the actuating portion occurred. The computing device may communicate with one or more servers and a cloud computing network.

20 Claims, 7 Drawing Sheets

WEARABLE TREATMENT SUBSTANCE DISPENSER

CROSS REFERENCE TO RELATED APPLICATIONS

Not Applicable

STATEMENT REGARDING FEDERALLY-SPONSORED RESEARCH OR DEVELOPMENT

Not Applicable

BACKGROUND OF THE INVENTION

Proper sanitization is important as a disease control measure in a variety of industries. The CDC estimates that about 1.7 million infections occur each year with one fourth attributable because of improper hand sanitization compliance in industries such as healthcare, hospitals, food service, restaurants, schools, and childcare, and at mass gatherings and conventions. Hand hygiene compliance management is important in hospitals given the risk of hospital-acquired infections. Reinforcement and improvement of hand hygiene standards is especially important where health caregivers may touch multiple patients each day with various contagions, potentially serving as a vector for the transmittance of multiple contagions. This is of particular concern because many hospitals lack hand hygiene compliance auditing tools, such as hand hygiene ledgers or records. In such hospitals there may be no accountability or reinforcement devices for healthcare providers. Interaction with patients is necessary to some who may be immunosuppressed, or in patient recovery rooms where infection may thrive. Katherine Ellingson, Ph.D., an epidemiologist at the CDC, has highlighted hand hygiene issues based on researched and identification of healthcare-associated infection risks through improper hand hygiene compliance. Infections from hand hygiene non-compliance still occur despite training initiatives, signage, and the convenient placement of handwashing sinks and sanitization stations in the industries where hand hygiene is important. This costs hospitals, institutions, governments, and society tens of billions of dollars yearly in preventable healthcare costs and early deaths.

A major concern in the healthcare industry, and of particular importance to hospitals, are readmission rates. Under Medicare and other legislation, government regulations incentivize hospitals to reduce readmissions by placing the cost burden of readmissions on the attending medical facility. From a compliance and prevention manager's perspective, providing convenient and easier methods and systems, or devices, to perform a routine treatment task generally means healthcare providers will perform the task more frequently. One objective of the invention is to enhance and change poor hand hygiene behavior to reduce infections and thereby reduce readmission rates.

Presently, many treatment substances, e.g., hand and body lotions, sunscreen protection, mosquito repellent, hand sanitizer, and liquid soaps, are typically sold in squeeze containers in order to dispense and apply a treatment substance. In the past other products such as sunscreen have been sold in bottles with a hand pump, or as a powder in a tube with a brush, or as an aerosol in a pressurized can with a nozzle. However, these containers and dispensers are not necessarily convenient. The bottles and containers are frequently dark or colorful and do not show clearly when the substance is used up, sometimes making a user feel reluctant to use the container because it may not contain enough treatment substance. Moreover, the containers are easy to lose or forget, e.g., in a car, cabinet, locker, or accidentally left somewhere in public. This can cause a user such as a healthcare provider, patient, or other user, to not adhere or apply the desired or needed treatment substance or take prescribed medication. For example, a user could misplace a sunscreen, pill or sanitizer bottle and then would forgo using sunscreen, or forgo taking medication, or sanitizing hands. Consequently, there is a need for a wearable treatment substance dispenser that clearly indicates to a wearer the level of treatment substance remaining. Further, there is a need to separate the container of treatment substance with a wearable dispenser allowing for replacement cartridges of treatment substance.

Besides hand hygiene non-compliance, two other important mechanisms help to drive up patient readmission rates: non-compliance with treatments or medication after patients are released, and bed sores. Frequently, patients who are released from a hospital will fail to properly take their medication. This occurs for a number of reasons but memory, confusion, reading comprehension, and improper recall of instructions are main causes, e.g., an individual will simply forgot to take the medication, will misremember taking it, will remember to take it, but then forget and take it again, will forget the instructions, will not be able to read and understand the instructions, or will not be able to recall what a pharmacist or doctor told them about how to take the medication. Similarly, with bed sores an important cause is that patients are not aware of how long they have been placing pressure at a certain angle on vulnerable parts of the skin or body. For example, patients may not be able to feel that a bed sore is developing because of the physiological mechanism of how bed sores develop, or because of a certain condition. Bed sores are extremely serious when and if they develop, and are very difficult to treat causing frequent and costly readmissions including surgeries, skin and tissue grafts, and generally increased care requirements from hospital caregivers. Bed sores may even result in amputations and death. Consequently, there is a need to inform patients or individuals having important medical instructions to follow them after they are released from a hospital or clinic or are otherwise no longer being cared for.

BRIEF SUMMARY OF THE INVENTION

Systems, methods, and means for a wearable treatment device are disclosed. Briefly described, one embodiment is a sanitizing system comprising a treatment substance dispenser typically affixed to a strap. The treatment substance dispenser has a cartridge containing a treatment substance and further comprises an actuating portion to displace the treatment substance from the cartridge. Upon actuation, a controlled amount of said treatment substance is dispensed from the treatment substance dispenser. Actuation may be facilitated with one or more buttons on the strap. Typically, a computing device is affixed to the strap comprising one or more wireless communications modules and one or more sensors. One of the sensors will usually determine whether an actuation of said actuating portion occurred.

In one embodiment the treatment substance dispenser may be used by a healthcare provider, employee, agent, patient, or contractor to assist with sanitization or other compliance. The computing device may communicate with one or more servers that facilitate monitoring sanitization or other compliance. The computing device may also communicate with a cloud computing network that may be connected to the network. The servers or network may transmit information to the computing device such as alerts, messages, or other indications.

DETAILED DESCRIPTION OF THE INVENTION

Figure 1:
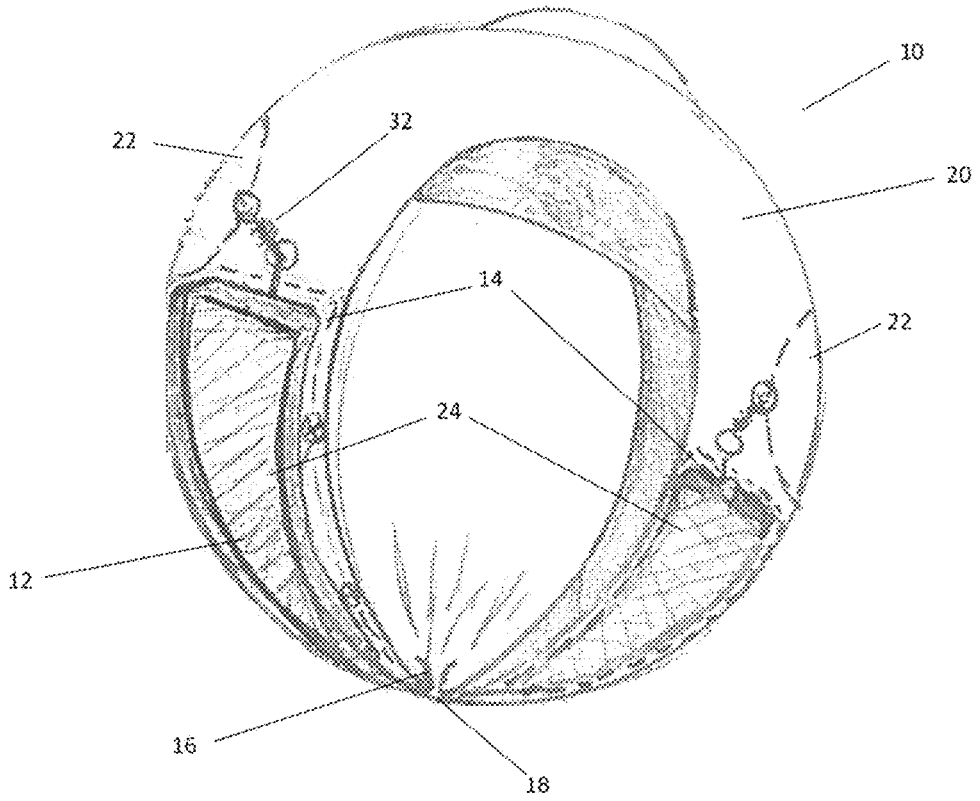
FIG. 1 illustrates an embodiment of the invention.

FIG. 1 illustrates an embodiment of the wearable treatment device 10. A strap 20 allows this embodiment to be worn on the wrist. A treatment substance dispenser 12 is shown with conjoined cartridges 14, a nozzle 16, and a backflow ring 18. In a typical use of the invention, a person would attach the strap 20 to his or her wrist with the nozzle 16 generally directed towards the palm of the hand. It is understood that the treatment substance dispenser 12 can apply many forms of substances including but not limited to liquids, aerosols, pastes, creams, and solids such as but not limited to pills, capsules, and powders. It is also understood that the nozzle 16 may be configured to, upon actuation of two portions of the straps (shown as two buttons 22 in FIG. 1), dispense, release, or otherwise provide output for a treatment substance in any of these forms. In certain embodiments, the nozzle 16 will be attached to a cartridge (or to conjoined cartridges 14 as in FIG. 1) containing treatment substance, as discussed below. The nozzle 16 is usually oriented at around a 90-degree angle so that it may dispense substance towards or onto a user's palm. Depending on the angle of the nozzle 16, a user may need to bend his or her palm slightly and immediately prior to actuation so that the nozzle 16 would direct the treatment substance towards and onto at least a portion the user's palm. Then the user could rub both of his or her hands together to properly apply the treatment substance—where the treatment substance is ethanol sanitizer, the method is effective at reducing over 99% of pathogens. Typically the type and size of nozzle 16 used is dependent on the type of treatment substance and its physical properties.

The strap 20 is typically comprised of silicon rubber or another flexible material. It may comprise an ergonomic surface designed for the comfort of a user who is wearing the device for long periods of time. In addition, the strap 20 may be comprised of a newly developed polymer material with a binding surface that prevents pathogens from accumulating on its surface. (*Microbe Adhesion Depends on Surface Stiffness; Researchers Craft Bacteria-Resistant Films,* 52 MIT Tech Talk 27 (May 21, 2008)).

After using the strap 20 to secure the device to a wrist, a person, in this typical embodiment, may actuate the buttons 22 by pushing on them. In most embodiments, a plurality of buttons 22 must be pressed at the same time for sufficient pressure to cause the treatment substance dispenser 12 to dispense a treatment substance from the conjoined cartridges 14. The sufficient pressure required for a dispensation is determined in part by the size or diameter of an orifice in a pressure ring 18. Requiring a plurality of buttons 22 to be pressed for a dispensation reduces the potential for accidental dispensation. As will be described in further detail with other figures, upon pushing a button 22 a lever is actuated (not shown in FIG. 1) causing the cartridge to reversibly deform, and compress and dispense the treatment substance. Pushing a button 22 also causes a spring 26 to compress against a rigid portion that may be within the strap 20 or cavity, and upon release of the button the lever actuates back to its original position. Also upon release of the button, assuming a dispensation occurred, then while the lever actuates back to its original position then certain embodiments of the pressure ring 18 allow a substance (typically air) to enter the cartridge in place of the now-missing treatment substance that was just dispensed.

The conjoined cartridges 14 comprise two cartridges in the FIG. 1 embodiment. A cartridge is at least any of the canisters known in the art that may be actuated to dispense a substance, typically a fluid. In the embodiment in FIG. 1, the conjoined cartridges 14 comprise two cartridges that are fluid sacs 24 that may be reversibly deformed by an actuating lever or clamping mechanism. In a typical embodiment, the cartridge 14 fits or is secured within a cavity in the strap 20, or within a plurality of cavities for a plurality of cartridges 14, conjoined or otherwise.

Figure 2:
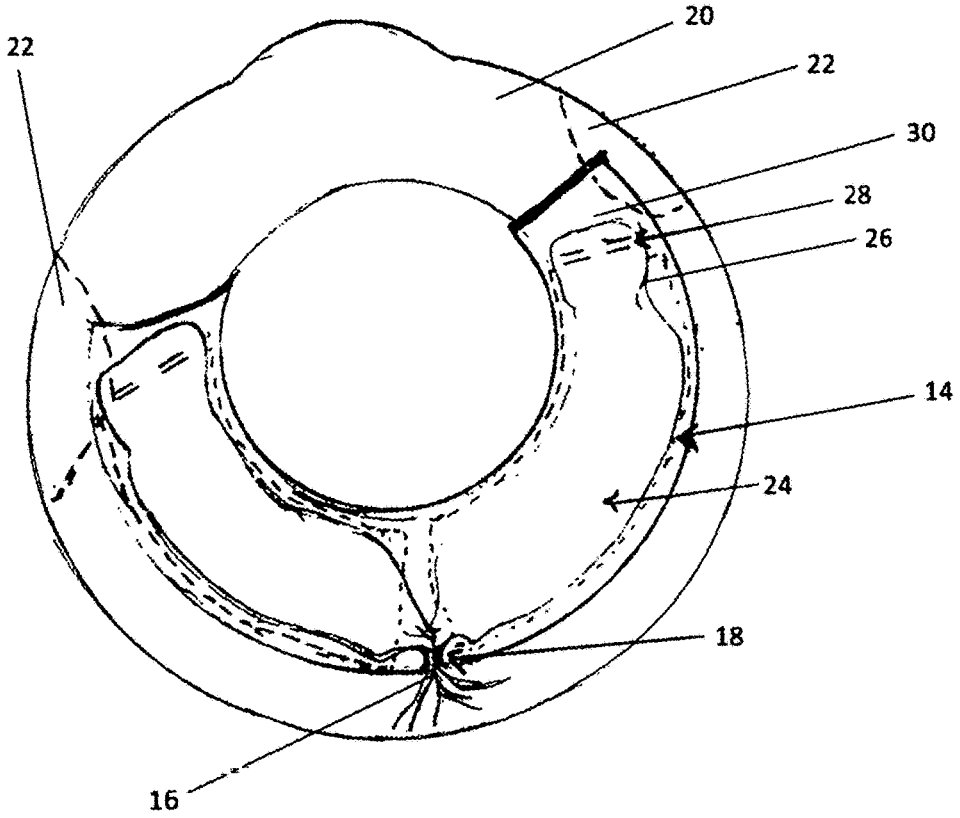
FIG. 2 illustrates a side view of an embodiment of the invention.

In FIG. 2, another embodiment of the invention, the cartridge 14 (indicated by a broken line) comprises a contour 26 and/or a ridge 28 so that it may snap into place within a cavity 30 in the strap, but prior art securing methods are also contemplated. Cartridges 14 may be replaced within the same cavity 30 by a refill cartridge 14, typically comprising the same silicon rubber. To replace a cartridge 14 a user may remove it from the cavity 30 in the strap 20. After the treatment substance cartridge 14 is removed from the cavity 30 it may be replaced by an appropriate cartridge of an appropriate treatment substance that will operate with the dispenser 12 and nozzle 16 (if the nozzle is not also removed). Certain cartridge 14 embodiments will have integrated or attached nozzles 16 such that removal of the cartridge 14 would also remove the nozzle 16, and the replacement cartridge 14 in such an embodiment would also typically be understood to have a nozzle 16. Nozzles 16 could also be separate components and therefore separately designed and replaceable.

The cartridge 14, or conjoined cartridges 14, are further designed such that the nozzle 16 dispenses an approximate amount of treatment substance upon each actuation (e.g., approximately 2.8 mL for an ethanol sanitizer embodiment), and the cartridge 14 may be sized to contain certain total volumes of treatment substance. A typical ethanol sanitizer with conjoined cartridges 14 would contain a total of 15 or 25 dispenses worth of ethanol sanitizer, or approximately 42 mL or 70 mL of ethanol sanitizer when approximately 2.8 mL is used for each dispense. Cartridges 14 may also be sized according to the size of the strap 20, which is separate from the total volume of treatment substance.

As shown in FIG. 2, in a typical embodiment, the cavity 30 containing a silicon rubber cartridge 14 typically extends into the sides of the strap 20. In such an embodiment, the actuation of the nozzle 16 occurs when a user puts pressure on the plurality of buttons 22. The user's pressure causes the silicon or other flexible material of the cartridge 14 to compress, causing displacement and/or pressure build-up in the substance and/or any of the air drawn inside the cartridge, and ultimately causing an amount of the substance to exit the nozzle 16 (usually approximately 2.8 mL) with a certain amount of velocity. In most embodiments, the velocity will be sufficient for the treatment substance to reach the palm of the user. In the embodiment in FIG. 2, with a conjoined cartridge 14 the user must put pressure on both buttons 22 at the same time in order to build up enough pressure inside the cartridge to cause a release of fluid through the pressure ring 18. Because both buttons 22 must be pressed this reduces the chance of accidental dispensing. The backflow of pressure ring 18 otherwise remains closed, although in some embodiments may let air through into the cartridge after dispensing, or another substance. In this embodiment, the fluid sacs 24, may extend out from the cartridges 14, and the cavity 30 is sized slightly larger than the fluid sacs 24 and the cartridges 14. In other embodiments the cavity 30 could be sized small or larger, and the cartridge may not contain a fluid sac 24 but rather a different internal component for containing a treatment substance. Also, the fluid sac 24 or other internal component for containing a treatment substance may not necessarily extend out from the cartridge 14.

Figure 3:
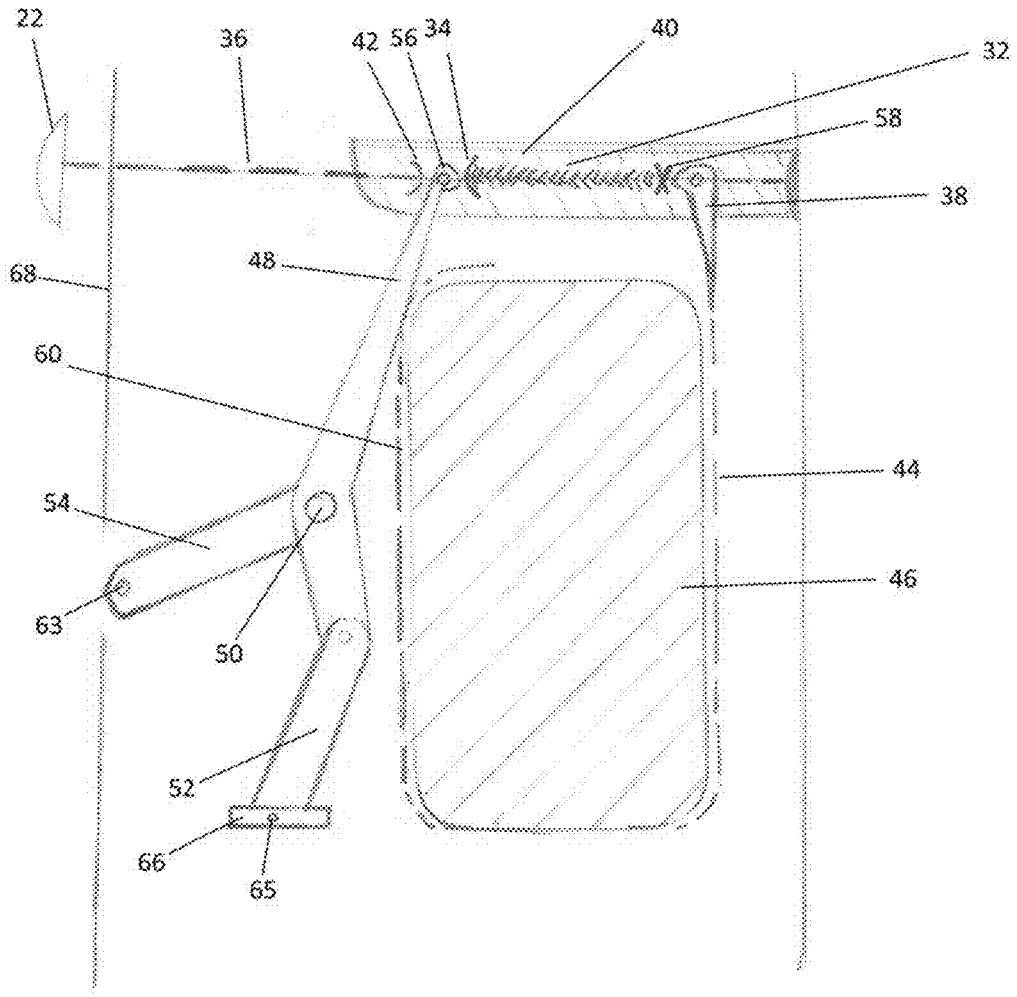
FIG. 3 illustrates an embodiment of an actuating portion in the invention.

FIG. 3 shows an embodiment of the invention and its operation to reversibly deform cartridges 14 and dispense a treatment substance. FIG. 3 shows one cartridge 14 of an ethanol sanitizer solution embodiment. As in FIGS. 1 and 2, the user would press the button 22 and cause the cartridge 14 to deform and displace and/or pressurize the sanitizer solution in its container 46 within the cartridge. The container 46 could be a fluid sac 24. Causing the cartridge 14 to deform could also displace and/or pressurize any other substance in the cartridge 14, such as air (similar to the operation of a consumer syringe bulb). While only one button is shown in this figure, typically there would be two buttons 22 that would need to be pressed causing 2.8 mL of ethanol sanitizer to dispense, or flow out past the pressure ring 18 and out of the nozzle 16 with sufficient speed to reach the user's palm.

When the button 22 in FIG. 3 is pressed, a rod 36 moves causing a first washer 42 to move a first lever pivot 56. This movement causes at least a first lever arm 48 to actuate, and also causes a second washer 34 to compress a spring 32. The spring 32 compresses a third washer 58 against a rigid body 38 connected to a rigid backstop 44. The rigid body 38 does not move as the spring 32 is compressed or as the rod 36 is pushed. In this embodiment, the rod is pushed and passes through a spring housing 40. In this particular embodiment, as the button 22 is pressed, the first lever arm 48 actuates on the first lever pivot 56 and on a second lever pivot 50, causing a second lever arm 52 and a third lever arm 54 to also actuate, pushing against and beginning to deform the cartridge 14. The second lever arm 52 pivots around a second lever arm pivot 65, and the third lever arm 54 may pivot around a third lever arm pivot 63. The second lever arm 52 typically would pivot around the second lever arm pivot 65 which rotates within a second lever arm housing 66, and which is connected or anchored to the strap 20. Typically the third lever arm pivot 63 will slide on or move adjacent to or in connection with a railing 68. In this embodiment these components, such as levers and pivots, will usually be comprised of metal, but other durable and rigid substances are also contemplated. The components will also usually fit within a cavity 30 in the strap 20 and would generally not be disposable.

The railing 68 is typically made of metal but could be any rigid or semi-rigid substance include plastics. In a typical embodiment the railing 68 is comprised within the strap 20. The railing 68 will typically be straight and will have two parallel portions extending substantially along its length to prevent a lever from deviating from a controlled path. Upon actuation the railing 68 will usually remain stationary and push back upon one or more levers, but it could be designed, in conjunction with the strap 20, to allow for some movement during actuation in connection with one or more levers pushing against it. In some embodiments the railing 68 could be curved to further control the motion of one or more levers to facilitate pressure applied through squeeze pads 60. In another embodiment the railing 68 could comprise a gear, chain, or chain-like or gear-like portions that serve to control the motion of one or more levers in connection with the railing. In still other embodiments the railing 68 could comprise ball bearings. Broadly, the configuration and embodiment of the railing 68 could be matched to a particular type, size, or style of cartridge, or to a cartridge that is designed for a particular treatment substances where such a cartridge would have special requirements during actuation, e.g., increased leverage or compression against it to properly dispense for a cartridge using a dense powder.

FIG. 3 also shows squeeze pads 60 around the cartridge 14 where the lever or levers will engage to compress and reversibly deform the cartridge 14. When used, squeeze pads 60 are typically constructed of a rigid, pliable, or semi-pliable material that can exert pressure over a particular area. In one embodiment they are constructed of a tough fabric-like material such as a dense non-woven plastic. In other embodiments the squeeze pads 60 will become denser upon compression and may be akin to a sponge-like material. In preferable embodiments the squeeze pads 60 do not puncture, or irreversible alter the cartridge 14. In some embodiments, the squeeze pads may be separate from a lever or levers, but in others the squeeze pads 60 are actually integrated into a lever or levers.

Figure 4:
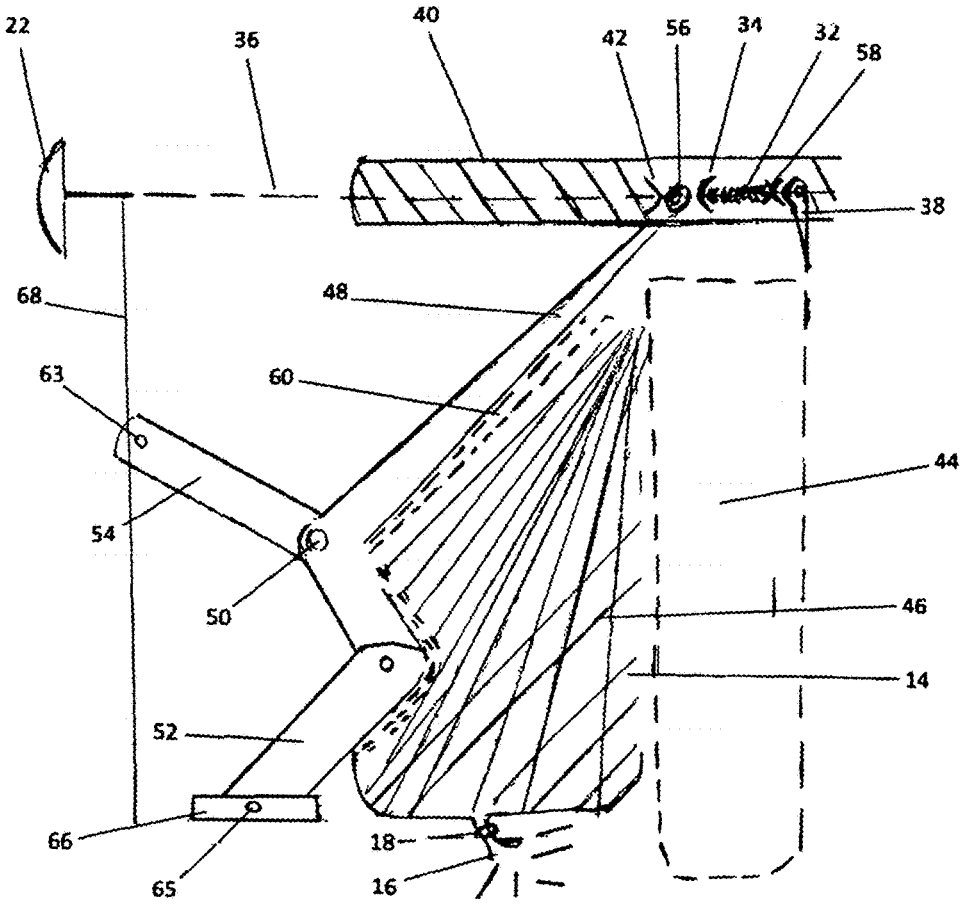
FIG. 4 illustrates another embodiment of an actuating portion in the invention.

FIG. 4 indicates another embodiment. Here, the button 22 has been pressed, pushing the rod 36 into the spring housing 40, and causing two washers 42, 34 to actuate the first lever 48 while compressing the spring 32 against another washer 58 and a rigid body 38. As the levers actuate the first and second lever 48, 52 compress the squeeze pads 60, which compress the cartridge 14 and the container 46 within the cartridge.

In both FIG. 3 and FIG. 4, when the button 22 is released by the user, the spring 32 acts to snap back, i.e., return to its original state. This spring force causes the washers 34, 42, to push the rod 36 into the first lever pivot 56, thereby actuating the levers in reverse and releasing the pressure from the squeeze pads 60. This allows the cartridge 14 to reform after its deformed state, which is shown in FIG. 4. Releasing the button 22 also resets the embodied mechanism of FIGS. 3 and 4 for a subsequent dispensing. In some embodiments, as more and more treatment substance is dispensed, a user would need to push the buttons 22 deeper in order to actuate the levers to create sufficient pressure to dispense the correct amount of treatment substance. However, a feature of the pressure ring 18 is that after dispensing when the spring 32 is returning to its original position, or the squeeze pads 60 are releasing their pressure on the cartridge 14, then the pressure ring 18 can then allow a substance (typically air) to enter the cartridge 14 in place of the now-missing treatment substance that was just dispensed. The next time a user presses a button or buttons 22, the levers would cause the squeeze pads 60 to then push on air inside the cartridge 14, and the air would push out the treatment substance. In this embodiment, a user would not need to keep pressing deeper and deeper on the buttons 22 as more and more treatment substance left the cartridge 14.

The amount of fluid released, i.e., after, as in most embodiments, both buttons 22 are pressed and sufficient pressure is placed by the squeeze pads 60 onto the cartridge 14, can be optimized or controlled by calibrating or configuring at least any of the washers 34, 42, the first lever pivot 56, the rod 36, the squeeze pads 60, the spring 32, the cartridge 14, and substance container 46. In a typical ethanol-based sanitizer embodiment, at least one of these are configured such that a dispensing action will release 2.8 mL sanitizer from a conjoined cartridge.

It is understood that FIG. 3 and FIG. 4 only show certain embodiments of the invention and its lever mechanisms. Other levers understood in the art could be incorporated into different configurations with certain advantages of disadvantages, including lever(s) that slide on a rail or rails as does the third lever arm 54 in FIGS. 3 and 4. Here, the minimal structure required to practice these embodiments is a single actuating lever, e.g., the first lever arm 48, that will serve to compress the cartridge 14 upon pressing a button 22.

Figure 5:
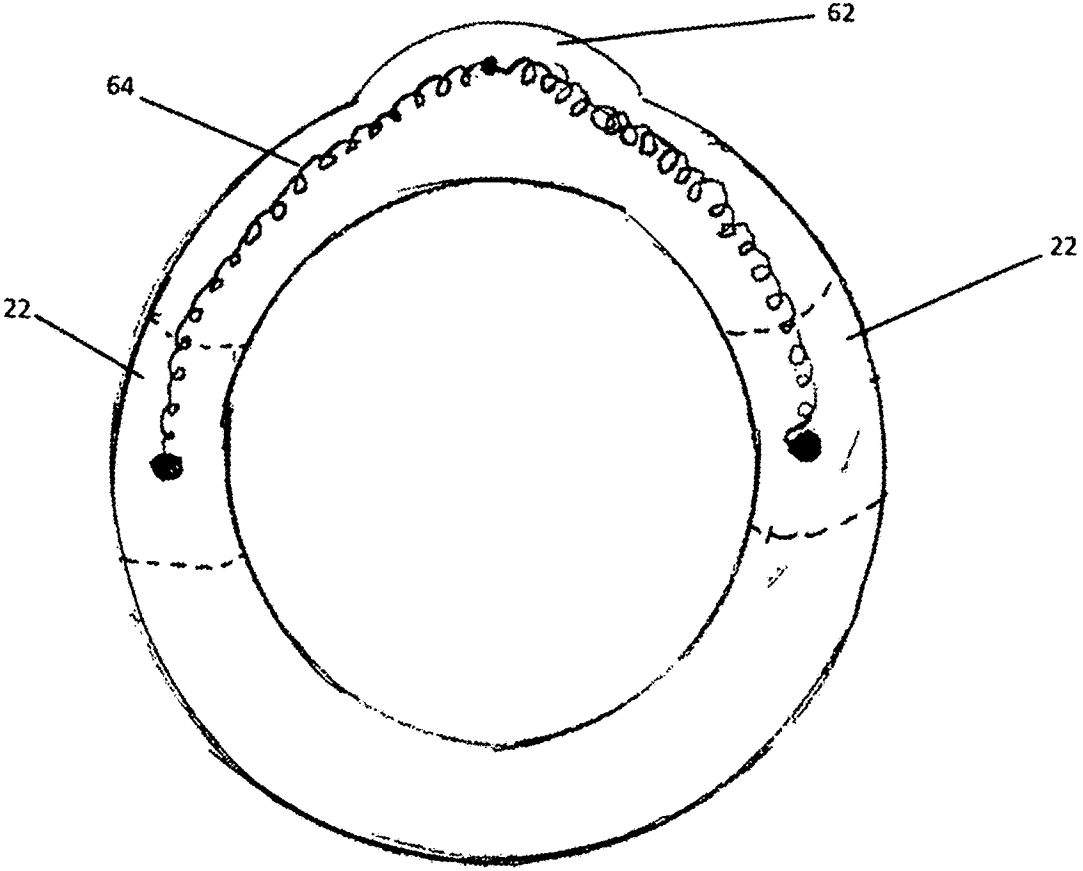
FIG. 5 illustrates an embodiment of leads in the invention.

FIG. 5 shows an embodiment with a computing device 62. In such embodiments, the actuation of the buttons 22 is detected by leads 64 in communication with the computing device extending down a portion of the strap 20 and/or the sides of the strap 20. In a basic embodiment, the leads 64 would connect near, on, or in the buttons 22 and an actuation of the buttons 22 would cause the leads 64 to close a circuit, indicating to the computing device 62 that a dispensation of treatment substance has occurred. As shown in this embodiment in FIG. 5, insulated leads 64 extend to both sides of the strap 20, and the circuit on both sides must be closed before the computing device 62 records or counts a dispensation of treatment substance—this is because in typical, but not all, embodiments both buttons 22 must be pressed for a dispensation to actually occur. In some embodiments, the leads 64 may be pressure-based, optical-based or electrical-based and may be placed in different areas in the strap 20 or even inside the cartridge 14 or container. In these embodiments, the leads 64 could detect the spring 32 compressing, or a lever actuating, or any of the movements that cause a compression of the cartridge 14 or container 46, or the actual compression of the cartridge 14 or container 46 itself, or a release of a treatment substance at the nozzle 16 or at the pressure ring 18, or in other locations within the embodiment where a POSITA would understand detection would be useful.

Figure 6:
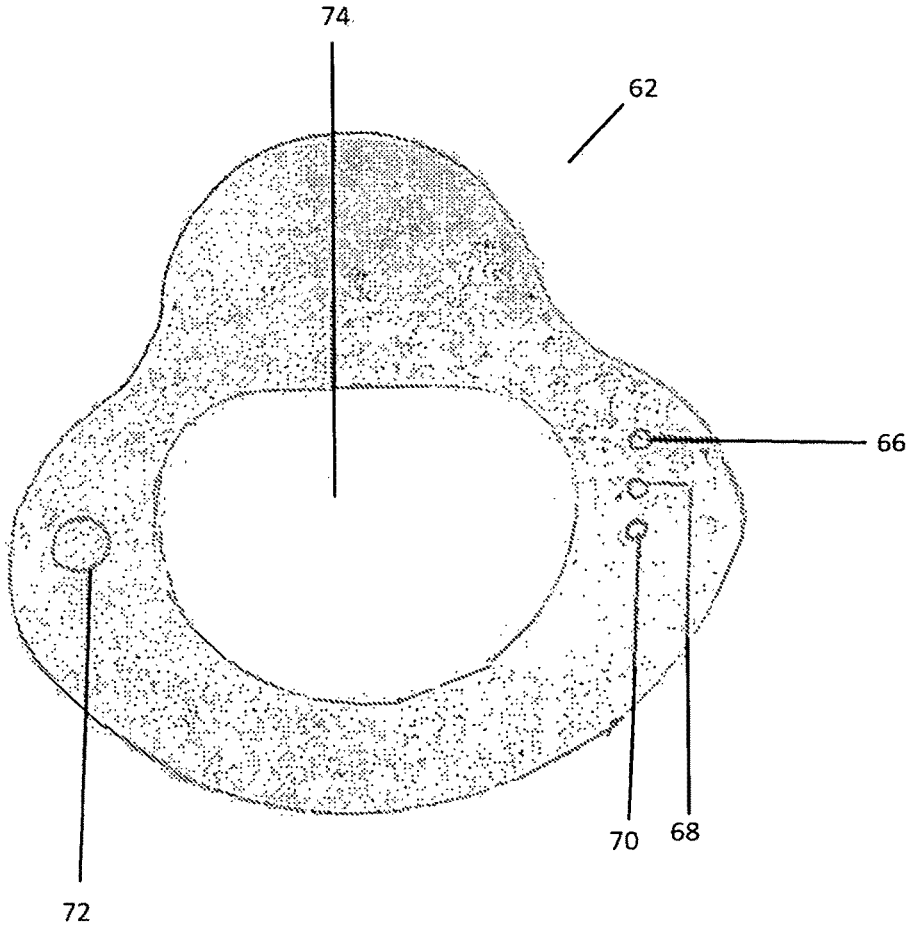
FIG. 6 illustrates a top view of an embodiment of a computing device in the invention.

FIG. 6 shows an embodiment of a computing device 62. The computing device 62 is typically affixed to the top of the strap 20 and the affixed computing device may be known as the crown. In a typical embodiment the computing device 62 is an Omega2 running the Linux operating system and operating off of Arduino hardware on a lithium battery (in a typical embodiment giving about 1-2 years of power). The computing device 62 is capable of wireless communication with other computing devices including Bluetooth and WiFi (e.g., 802.11 b/g/n, Cellular 2G/3G, Bluetooth 4.0, GPS expansions). The computing device 62 hardware may contain expansion docks, a cellular data expansion, an Arduino dock, a servo expansion, relay expansion, an organic LED (OLED) display or expansion, and a custom designed breadboard dock to be plugged into a breadboard expansion. The Linux operating system that the computing device 62 may use, may run many commercially available programming languages including Javascript, Python, Diamond, C++, Node, PHP, and many others. It may also operate as a server using, e.g., Apache, and is integrated with cloud computing, e.g., Onion Cloud. This allows remote control anywhere in the world with a real-time UI or RESTful API's. It also allows deployment of software updates in the field.

As discussed, the computing device 62 also detects when a user actuates the device to dispense a treatment substance—the leads that connect to the computing device 62 are not shown but would be present in this embodiment in a communications input/output port. The computing device 62 will determine, based on the total number of actuations, and the type and size of the cartridge 14, which it may detect or would be pre-programmed, how much treatment substance has been dispensed, and in turn how much treatment substance remains in the cartridge 14. In this typical embodiment, the computing device 62 may create an alert that a cartridge's 14 treatment substance is at a low level. This alert could be transmitted or indicated to anyone, including the user via one or more indicators 66, 68, 70, or wirelessly to any other computing device to which it is directly or indirectly connected.

The computing device 62 is understood to control the plurality of indicators 66, 68, 70 to indicate messages about the performance or connectivity of the computing device 62, including error messages, and also to indicate the status of data that the computing device 62 has received. Typically, the plurality of indicators 66, 68, 70 would take the form of LED lights, but could also include displays. The main display 74 is any display known in the art, and typically it comprises a high definition touch screen display such as those currently used on smartphones. The computing device 62 also typically includes a main display 74. In a preferred embodiment the main display 74 indicates at least the level of treatment substance in the dispenser, e.g., typically starting with the number of cartridge 14 dispensations available or remaining, and reducing by one upon each actuation (or upon each determination by the computing 62 interpreting data sent from the leads 64). A custom indicator 72 is another display that a user or manufacturer could program to indicate any number of configurations or any data received or in the memory of the computing device 62.

In a preferred embodiment the indicator 66 is a white light that indicates alerts to the user such as a low-level warning, i.e., that a cartridge or a plurality of cartridges are at or near a level where replacement is recommended or critical for continued dispensation of treatment substance. In a preferred embodiment, the indicator 70 is a red light to indicate non-compliance. As an example, if a healthcare worker entered a room and was detected by a wireless device or motion detector near the doorway and did not actuate the dispenser in a reasonable amount of time an alert would be communicated to the dispenser causing a red light in the indicator 70 to illuminate. Similarly, the indicator 70 may illuminate if the user did not actuate the dispenser prior to leaving a room and such non-compliance was detected by devices in the room and communicated to the computing device 62. A red light would indicate non-compliance typically after a reasonable amount of time passed and the healthcare worker still had not actuated the dispenser. In a preferred embodiment, the indicator 68 would be a green light that would indicate proper compliance when illuminated. Extensions or add-ons to the computing device 62, connected to the strap 20, may vibrate or cause a sound for various levels of compliance or non-compliance instead of or in addition to the indicators 66, 68, 70. The custom indicator 72 may also be used to indicate compliance or non-compliance.

It is understood that the computing device 62 in FIG. 6 would also have a human interface (not necessarily shown), i.e., an interface used by a human to interact with the computing device 62. Human interfaces contemplated for this device include, without limitation: a button or plurality of buttons actuated by a user's finger to operate the computing device 62; a keyboard; a track ball or track-ball like device; a microphone or plurality of microphones; a touch screen or plurality of touch screens (including indicators 66, 68, 70, and 72 which could be touch screens), which may encompass a small or large portion, or all of the top portion of the crown of computing device 62. Any of the touch screens, including the main display 74, may be used to operate the computing device 62 to function as an entertainment device or gaming device, e.g., for children on vacation at the beach who bring an embodiment of the invention with them with a cartridge 14 containing sunscreen.

It is further contemplated that an optional access panel is understood to provide a user with a way to replace a battery or to replace the computing device 62 or parts thereof. Depending on the embodiment the access panel may or may not be openable or removable by the user who typically wears it.

The strap 20 may contain one or more sensors (not shown) configured to send or receive data or physiological information to the computing device 62. A sensor could either be positioned to be worn on the top or the bottom of the wrist and could detect and transmit a variety of available physiological information, including but not limited to heart rate, breathing rate, or number of steps taken.

Figure 7:
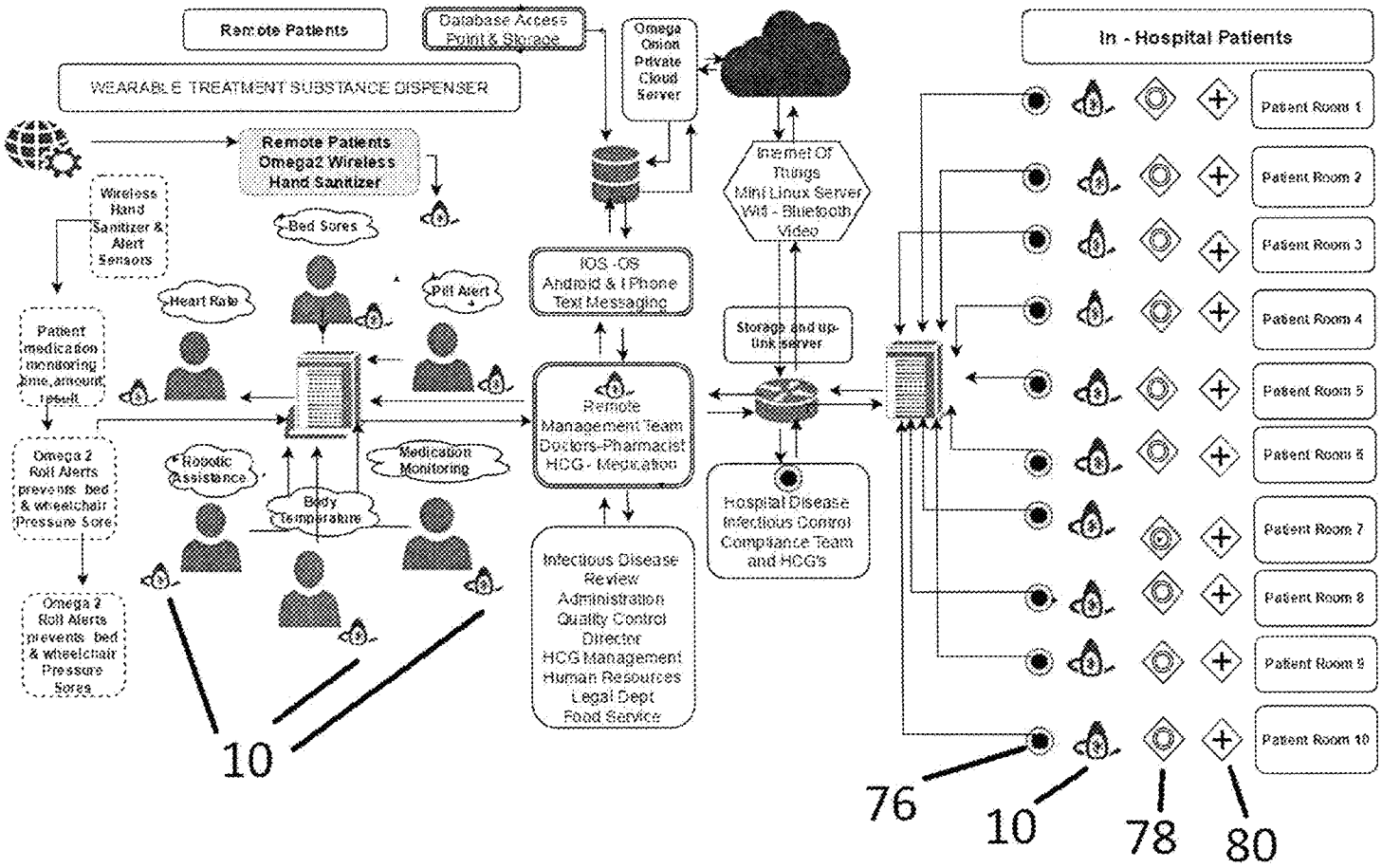
FIG. 7 illustrates a cloud computing and compliance embodiment.

FIG. 7 shows a cloud computing embodiment with servers, including an Onion server, that communicate with computing devices 62 on one or more wearable treatment substance device 10, through wireless means. A plurality of each computing device 62 is shown, but it is understood by one of skill in the art that one or more of any of the computing devices could be used in a cloud computing embodiment, and one or more servers could be used that are connected to each other through various means. The servers may also be connected to the Internet, enabling further communication with any other device connected to the Internet, as would be understood by one of skill in the art. This is particularly useful for remote patients, e.g., those at home on bed rest.

In a typical application, a group of users in an industry requiring compliance logs of hand sanitization (e.g., healthcare, where users would be nurses, doctors, or anyone else with physical patient interaction) would all wear the treatment substance devices 10. Each time sanitizer was dispensed, the computing device 62 would detect the dispensation and wirelessly transmit the dispensation to a compliance log, e.g. through a server such as the Onion Server. Servers may be located on the same floor or in the same facility or may be connected remotely to a facility via the Internet. The compliance episode would be logged, timestamped, and compared with the worker's location and what patient the worker was visiting with at the time. Typically, the computing device would connect wirelessly to other devices though means such as Bluetooth or Wifi, although any wireless communication signal known in the art could be employed, particularly in the healthcare industry where special wireless communication technology may be used because of the presence of machines sensitive to electromagnetic signals.

The plurality of wearable treatment substance dispensers 10 are shown in the FIG. 7 embodiment as being in wireless communication with a server or servers. Although not shown in this figure, the wearable treatment substance devices 10 could also wirelessly communicate through Bluetooth or WiFi or other wireless means with other computing devices including other wearable devices. The wearable treatment substance devices 10 may also have one-way RFID communication. Typically, however, the wearable treatment substance devices 10 would only communicate with a server or plurality of servers. Such communication could be accomplished through an access point 76, e.g., a router or wireless access point, which would be located in patient rooms and throughout the hospital to ensure uninterrupted communication between the computing device and server(s).

In one cloud-computing embodiment, the wearable treatment substance device 10 would constantly transmit the level of sanitizer remaining in a healthcare worker's cartridge 14 to a server where other software could manipulate, transmit, alert, or display the information. For example, an alert could be displayed on a manager's computer dashboard showing that a worker was low on sanitizer solution. When the treatment substance in a healthcare worker's cartridge is completely expired, the worker would remove and replace the expired cartridge with a new cartridge of the same or a different treatment substance.

FIG. 7 shows one or more compliance sensors 78 that may be located in various places in a healthcare or other facility. In this embodiment, they are placed in connection with the patient rooms but it is understood that typically they would be throughout the hospital. In a typical application, the plurality of sensors 78 would be located near a door used by a healthcare provider to access a patient, e.g., in a waiting room, examination room, or operating room. More broadly, such sensors would be placed at any entrance or exit nodes flagged by appropriate compliance employees where hand hygiene and sanitation compliance is important or critical. The compliance sensor 78 would detect whether a healthcare provider entered or exited via wireless communication technology, most typically Bluetooth or RFID, and would notify a server or servers. The server in communication with the wearable device would then track whether the user actuated the wearable treatment substance device 10 to apply a treatment substance (e.g., sanitizer) within a certain period of time customizable by an employer or compliance manager. The server could send any information or communications to the wearable device 10 causing any of the indicators 66, 68, 70, 72 or the main display 74 to change status or issue a warning or notice of hand hygiene non-compliance to the user. Similarly, tracking sensors on wall sanitizer dispensers or sinks 80 could sense when a device on a user's wrist is nearby, and could determine whether sanitizer is dispensed, or whether hot water and soap are used, indicating that hand hygiene compliance has been achieved. This information would be communicated back to a server, and various information could be communicated to the device. Handwashing sensors would operate in a similar fashion to the tracking sensors on wall sanitizer dispensers 80 and could detect the proximity of a user's wearable treatment substance device 10, whether the faucet has been activated, for how long, the temperature of the water released, and the type and amount of soap or handwashing substance released.

In other embodiments, compliance sensors 78 could send and/or receive communication from the computing device 62 and could be affixed near or on entryways or wall sanitizers where compliance is necessary to determine if anyone who is entering has recently sanitized their hands. For example, the door to a surgical operating room might have such a device affixed to the door or near it. If anyone attempted to enter without having sanitized their hands within a certain period of time then an alarm (e.g., buzzing, or sounds either in the room or facility or on the wearable dispenser) could notify the person and others nearby who was not in compliance, and/or would notify other healthcare workers or management responsible for maintaining patient safety, sanitization compliance, or employee compliance in real-time.

All hand hygiene events, whether compliant dispensations of sanitizer, or hand washing, or non-compliance in a reasonable amount of time (for whatever the reason) are understood to be communicated to and tracked by a server. The server, in turn, could be accessed by, or could push alerts, notifications or other information to employees or managers (such as a team leader, floor nurse manager, or hand hygiene compliance manager) on handheld devices such as pagers or smartphones, or to desktop workstations. In the foodservice industry, alerts may be especially important and could be sent in real time to a restaurant manager if wait-staff are in non-compliance (e.g., sensors and wearable devices as described herein could detect wait-staff exiting a bathroom and failing to sanitize or wash hands). The cloud computing system is operable with, and may communicate with PC, Android, OS, iOS and other operating systems.

Compliance databases and logs store information about the compliance location, time, the user(s), and what substance was dispensed. Other information could also be logged or stored to promote efficiency such as tracking the amount of sanitizer remaining in wall-based sanitizer stations 80 or in cartridges 14 and the amount of time taken for proper handwashing. Hardware add-ons or additional sensors connected to an Omega computing device could track users throughout the facility or hospital in real time, and this data could be gathered, stored, and analyzed.

Typically, a user such as a nurse or healthcare practitioner is assigned to one wearable treatment substance device 10. Assignment is typically either by a login process on the computing device 62, including via touch-ID, or via a unique code or marker in the computing device 62 that may be communicated to a server. Because each individual can typically be recognized by his or her wearable device, this allows the server to provide notifications or a notification nudge to help ensure compliance. A notification nudge ("nudge") is a type of alert that the server will send to the user's uniquely identifiable wearable device via a visual or audible alert on the device through indicators 66, 68, 70, 72, or the main display 74, or other human interface. A nudge is communicated when and if the user needs to take an action. For example, compliance sensors 78 may prompt a user, through the server, or even directly to the wearable treatment substance device 10, to comply with hand hygiene within a reasonable time period. Even though signs may be posted or the user may have training to sanitizer his or her hands after entering or exiting a certain area, workflow pattern fatigue may set in after time and the user may forget. The "nudge" feature helps to prevent this. It is noted for clarification that while "user" is typically used as someone who is wearing the treatment substance device 10, a "user" in the cloud computing context is actually any person authorized or otherwise accessing the network of which the treatment substance devices 10 are a part. This can include, e.g., compliance officers, agents, or managers, or healthcare providers monitoring information on the network.

While nudges are typically embodied in the hand hygiene context or in the context of dispensing the treatment substance in the wearable device, they may also be used to alert and monitor bed rolling (for example through an accelerometer in the computing device 62) and wheelchair movement to prevent bed sores, and to prompt users to take medication. Nudges may be pre-programmed into the wearable treatment substance device 10, or may be pushed by a server via an algorithm or monitored by a compliance agent. They may also be pushed by other devices such as desktop computers, smartphones, or servers, through a server and to the wearable treatment substance device 10. The nudges may also provide information through the indicators 66-72, or on the main display 74. Such information could include instructions, details about risks, warnings, and may show which pill a user should take, the color of the pill, and the time it should be taken. Multiple nudges may be pushed or pre-programmed to ensure compliance. Nudges may be used for inpatients or remote patients. In particular, when nudges are used in connection with remote patients, they have the effect of reducing readmissions. Nudges, however, are only one type of alert.

It is emphasized that the embodiments described above are merely examples of the disclosed systems, methods, and means. Many variations and modifications are understood to be able to be made to the embodiments described above, and those variations and modifications are to be included within the scope of this disclosure and invention.

What is claimed is:

1. A wearable sanitizing system comprising:

a treatment substance dispenser affixed to a strap and securing a deformable cartridge within the strap, the cartridge being configured to contain a treatment substance, wherein said treatment substance dispenser comprises an actuating portion comprising:

a button embedded in the strap;

a nozzle that is spaced apart from the button and integral with the cartridge, wherein the nozzle is configured to dispense the treatment substance; and at least one lever coupled to the button and configured to pivot around a first pivot to selectively contact and deform the cartridge to displace said treatment substance causing a configured amount of said treatment substance to be dispensed from said treatment substance dispenser through the nozzle; and a computing device affixed to the strap comprising one or more wireless communications modules and one or more sensors, wherein at least one of said sensors determines whether an actuation of said actuating portion occurred.

2. The system of claim 1 wherein said actuating portion further comprises a spring configured to bias the button.

3. The system of claim 2 wherein said actuating portion further comprises a rod that presses inward upon pressing said button; wherein said rod compresses said spring and actuates said at least one lever around the first pivot; wherein, upon release of the button being pressed, said spring expands returning to its original position, pushing said rod outward, and returning said at least one lever to its original position.

4. The system of claim 3 further comprising a plurality of actuating portions corresponding to a plurality of cartridges.

5. The system of claim 4 wherein at least two different cartridges of said plurality of cartridges contain different treatment substances.

6. The system of claim 4 wherein the button is a first button, and the plurality of actuating portions further comprise a second button, and the first button and the second button must be pressed together to release said treatment substance from said plurality of cartridges.

7. The system of claim 1 wherein said cartridge contains an ethanol-based hand sanitizer solution, and wherein said strap is comprised of an elastomer and comprises a nozzle and a pressure ring.

8. The system of claim 1 wherein said strap is comprised of a material resistant to microbe growth.

9. The system of claim 1 wherein said computing device indicates diagnostics to at least one user, wherein said diagnostics include at least information about a plurality of levels of treatment substance within said cartridge, and information indicating compliance or non-compliance.

10. The system of claim 1 wherein said cartridge is reversibly secured and disposable.

11. The system of claim 10 wherein said computing device indicates to at least one user that said cartridge may be discarded.

12. The system of claim 1 wherein said computing device wirelessly communicates information to a server.

13. The system of claim 12 wherein said information relates to time, location within a building, and actuation of the treatment substance dispenser, and wherein at least one user may access said server and analyze said information.

14. The system of claim 1 wherein a tracking sensor communicates with a server or with said computing device to determine whether said actuating portion has been actuated, and wherein said server or said tracking sensor communicates to said computing device indicating to at least one user whether actuation has occurred.

15. The system of claim 1 wherein said computing device comprises a touch screen and a speaker.

16. The system of claim 1 wherein said computing device is connected to a sensor comprising an accelerometer.

17. The system of claim 1 wherein said computing device contains programmed directions displayed to at least one user regarding medical treatment or healthcare instructions.

18. A method of manufacturing a wearable treatment substance device, the method comprising the steps of:

(A) affixing a treatment substance dispenser to a strap, the treatment substance dispenser configured to secure a deformable cartridge within the strap, the cartridge being configured to contain a treatment substance, wherein said treatment substance dispenser comprises an actuating portion comprising:

a button embedded in the strap;

a nozzle that is spaced apart from the button and integral with the cartridge, wherein the nozzle is configured to dispense the treatment substance; and at least one lever coupled to the button and configured to pivot around a first pivot to selectively contact and deform the cartridge, displacing said treatment substance thereby causing said treatment substance to dispense through the nozzle; and (B) combining the treatment substance dispenser with a computing device affixed to the strap comprising one or more wireless communications modules and one or more sensors, wherein at least one or more of said sensors determines whether an actuation of said actuating portion occurred.

19. A method for wearable sanitizing compliance, the method comprising the steps of:

one of permitting, mandating, or requiring healthcare providers, employees, agents, patients, or contractors to use or wear a treatment substance dispenser affixed to a strap, or providing to healthcare providers, employees, agents, patients, or contractors a treatment substance dispenser affixed to a strap;

wherein said treatment substance dispenser comprises:

a reversibly secured deformable cartridge within the strap, the cartridge being configured to contain a treatment substance; an actuating portion comprising:

a button embedded in the strap;

a nozzle that is spaced apart from the button and integral with the cartridge, wherein the nozzle is configured to dispense the treatment substance; and at least one lever coupled to the button and configured to pivot around a first pivot to selectively contact and deform the cartridge, displacing the treatment substance and causing said treatment substance to be dispensed from the treatment substance dispenser through the nozzle; and a computing device capable of recording information about said actuation; and, at least one indicator capable of indicating to at least one user the remaining amount of said treatment substance available.

20. The method of claim 19, wherein said computing device may transmit at least said information to a server monitored by a compliance agent, a compliance officer, a manager, a healthcare provider, or an employee, contractor, or agent of a healthcare provider.

* * * * *